United States Patent [19]

Andoh et al.

[11] Patent Number: 4,619,310

[45] Date of Patent: Oct. 28, 1986

[54] SUPPORTING AND GUIDING APPARATUS CONTINUOUS ROUNDS CASTING

[75] Inventors: Tsuyoshi Andoh; Toshio Kanamori, both of Niihama; Takashi Yamaguchi, Wakayama; Hiroshi Tomono, Wakayama; Satoshi Satake, Wakayama, all of Japan

[73] Assignees: Sumitomo Heavy Industries, Ltd., Tokyo; Sumitomo Metal Industries, Ltd., Osaka, both of Japan

[21] Appl. No.: 675,316

[22] Filed: Nov. 27, 1984

[30] Foreign Application Priority Data

Nov. 30, 1983 [JP] Japan ..... 58-226640

[51] Int. Cl.[4] ..... B22D 11/128

[52] U.S. Cl. ..... 164/448; 164/442; 226/177; 226/190

[58] Field of Search ..... 164/442, 448, 464, 465, 164/421, 422; 226/177, 190, 191, 198

[56] References Cited

U.S. PATENT DOCUMENTS

| | | | |
|---|---|---|---|
| 2,316,117 | 4/1943 | Tilley | 226/177 X |
| 3,318,005 | 5/1967 | Petersen | 226/190 X |
| 4,294,306 | 10/1981 | Berenov et al. | 164/448 |

FOREIGN PATENT DOCUMENTS

| | | | |
|---|---|---|---|
| 1911661 | 10/1970 | Fed. Rep. of Germany | 164/442 |
| 626772 | 10/1961 | Italy | 226/190 |
| 423914 | 11/1966 | Switzerland | 226/198 |
| 663351 | 12/1951 | United Kingdom | 226/190 |
| 1093880 | 12/1967 | United Kingdom . | |
| 1136203 | 12/1968 | United Kingdom . | |
| 1433683 | 4/1976 | United Kingdom . | |
| 1516221 | 6/1978 | United Kingdom . | |
| 1517534 | 7/1978 | United Kingdom . | |
| 1542924 | 3/1979 | United Kingdom . | |
| 899339 | 1/1982 | U.S.S.R. | 226/190 |

OTHER PUBLICATIONS

Obering, H. S. et al., *World Steel & Metal Working,* vol. 5, 1983, pp. 92–93.

*Primary Examiner*—Nicholas P. Godici
*Assistant Examiner*—J. Reed Batten, Jr.
*Attorney, Agent, or Firm*—Burns, Doane, Swecker & Mathis

[57] ABSTRACT

A plurality of sets of three rolls are disposed around the periphery of the round continuously drawn from a mold and movable to the direction for or counter to the rounds, the sets being disposed along the drawing direction of the rounds. It is not necessary to replace the apparatus even when the size of the round is changed due to the replacement of molds, as the roll position are adjustable to the rounds.

20 Claims, 3 Drawing Figures

FIG. 4
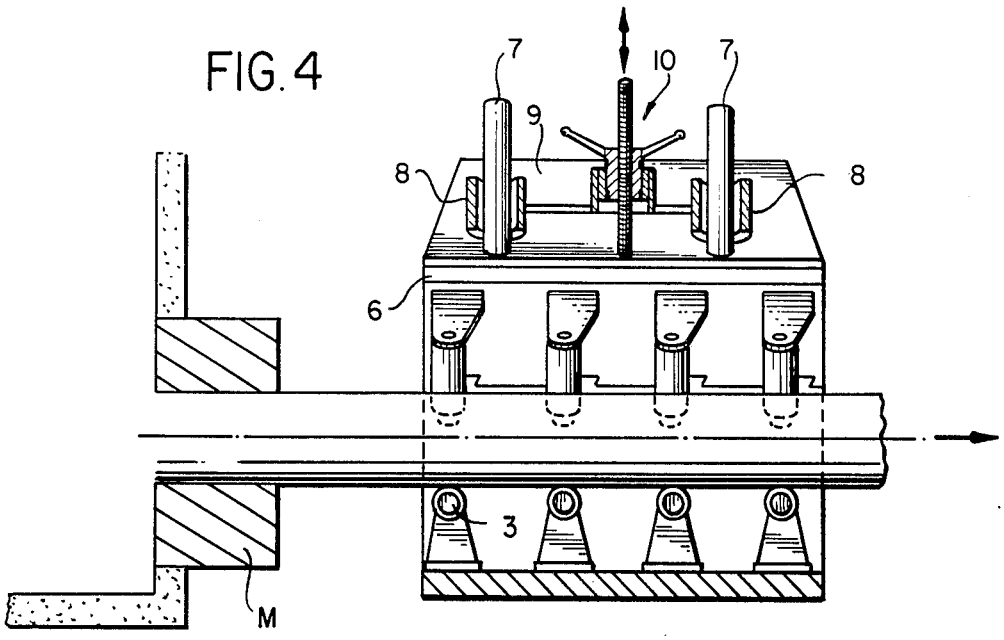
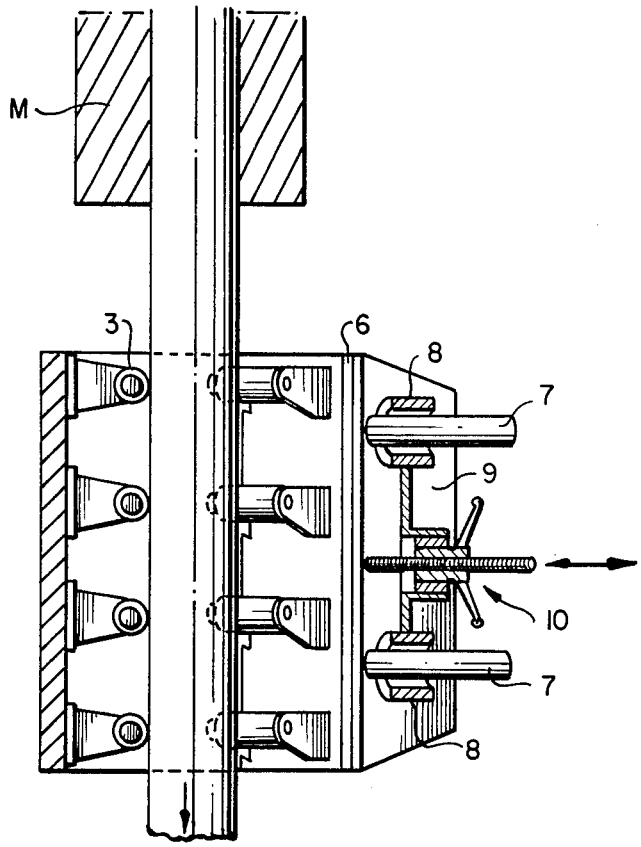
FIG. 5

SUPPORTING AND GUIDING APPARATUS CONTINUOUS ROUNDS CASTING

BACKGROUND OF THE INVENTION

1. Field of the Invention

The present invention relates to an apparatus for supporting and guiding a round bar at the downstream side of the mold while the round bar is cast by the continuous rounds casting machine.

2. Description of the Prior Art

A conventional type of supporting and guiding apparatus for continuous rounds casting, as shown in FIG. 1 depicting the cross section thereof, is in such a structure that pillar-like frames 1, 1, . . . are arranged in positions surrounding the round bar A so that the longitudinal direction thereof is along the drawing direction of the round bar A and rotational axes of four rolls 2, 2, . . . are fixed to four pillar-like frames respectively so that the four rolls 2, 2, . . . may be brought into rolling-contact with the round bar A at four points on the periphery thereof. A plurality of sets of rolls each consisting of four rolls 2, 2, . . . as above-mentioned are provided along the longitudinal direction of pillar-like frames 1, 1, . . .

In such a conventional structure as above, when the size (diameter) of a round bar A is changed due to the replacement of molds, a supporting and guiding apparatus for continuous rounds casting must also be replaced by the other fit one to the changed size, thereby requiring preparation of various kinds of supporting and guiding apparatus. For example, on the assumption that the kinds of sizes of round bars castable by the continuous casting machine are five and the number of strands is six, at least thirty sets of apparatus are required. In practical operation, however, two to three times as many sets as those required at the minimum, that is, 60 to 90 sets, are required for troubles and repairs of apparatus. This large number of sets requires a large expense for maintenance and management of the apparatus and a large space for storage thereof.

Further, there is a problem since a long period of time for the replacement of apparatus is required. As an index of productivity in continuous casting operation, a monthly casting time rate such as (Net casting hour/Total hour per month) $\times$ 100 (%) is employed. The higher the rate, the greater the productivity. In the continuous casting machine for casting various sizes of round billet, which require the changing of the mold according to the size, it is usual that about five to six hours are required for changing of round bar size because of the replacement of supporting and guiding apparatus along with that of molds. This changing has been a cause of low level of the abovesaid monthly casting time rate.

Further problem is that spaces for setting sprays for cooling the round bar are insufficient since rolls are mounted on four pillar-like frames disposed around a round bar. Accordingly, almost no gaps are provided between the frames, rolls, and round bar for setting the sprays.

Moreover, a dummy bar used in the beginning of continuous casting is attended by a problem as follows:

A dummy bar is roughly divided into three parts, one being a head to prevent the molten metal from flowing out from the mold at the start of molten metal pouring and to serve as a connecting part with a round bar to be cast and the other being a common part and a transition part for drawing the head in the direction of drawing of the bar. In the conventional apparatus, the transition part must have a diameter which is the same as diameter of the billet and is sufficiently as long to reach the lowermost end of the supporting and guiding apparatus because rolls are fixed so as to surround a round bar from four directions.

OBJECT OF THE INVENTION

The present invention was initiated in view of the above problems and a first object thereof is to provide a supporting and guiding apparatus for continuous rounds casting without requiring the replacement of apparatus even when the size of round bar cast by continuous casting machine is changed.

A second object of the present invention is to provide a supporting and guiding apparatus for continuous rounds casting which can serve for reducing a required number of sets thereof per set of continuous casting machine.

A third object of the present invention is to provide a supporting and guiding apparatus for continuous rounds casting intending to raise productivity in continuous casting operation by enabling cutting of time required for changing of the round bar size cast by continuous casting machine.

A fourth object of the present invention is to provide a supporting and guiding apparatus for continuous rounds casting which can afford ample spaces permitting installation of sprays for cooling the round bar cast by continuous casting machine.

A fifth object of the present invention is to provide a supporting and guiding apparatus for continuous rounds casting which permits reduction of the size of the transition part of dummy bar and extension of the common part of dummy bar.

The above and further objects and features of the invention will more fully be apparent from the following detailed description with reference to accompanying drawings.

BRIEF DESCRIPTION OF THE DRAWINGS

FIG. 4 is a schematic cross-sectional view of a supporting and guiding apparatus of the present invention on a horizontal continuous casting machine; and FIG. 5 is a schematic cross-sectional view of a supporting and guiding apparatus of the present invention on a vertical continuous casting machine.

DETAILED DESCRIPTION OF THE INVENTION

The present invention will be described with reference to drawings showing an embodiment thereof.

Figure 2:
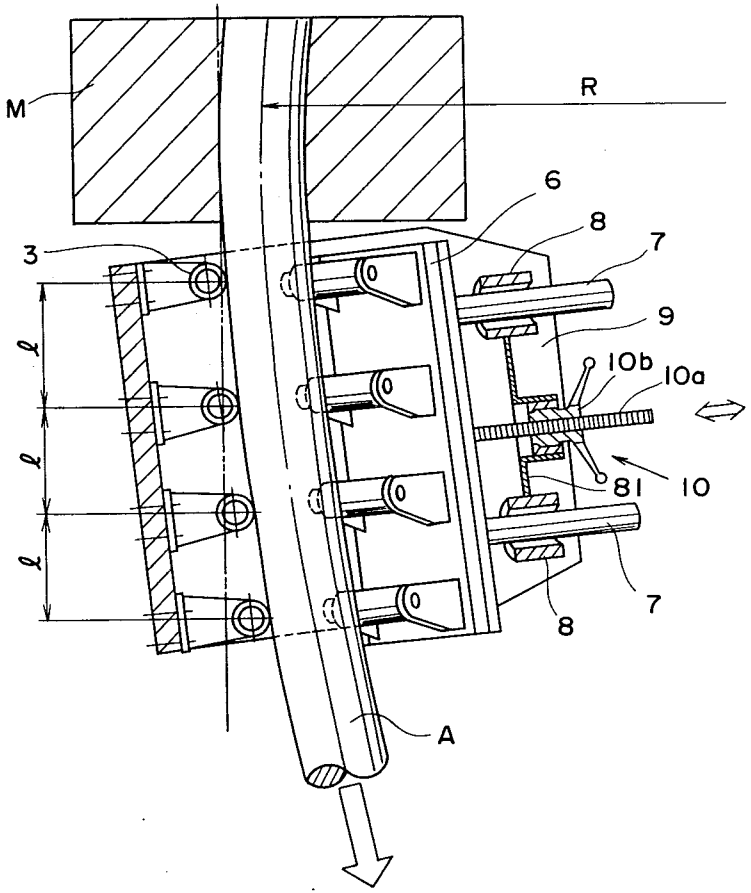
FIG. 2 is a schematic side view of the structure of a supporting and guiding apparatus for continuous rounds casting of the present invention; and, FIG. 3 is a schematic cross sectional view thereof.
Figure 1:
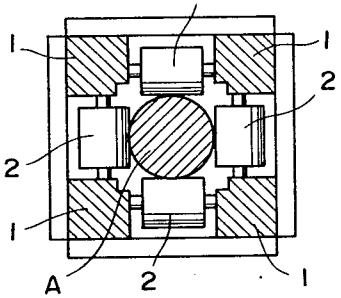
FIG. 1 PRIOR ART
FIG. 1 is a schematic cross sectional view of the structure of a conventional supporting and guiding apparatus for continuous rounds casting.
Figure 3:
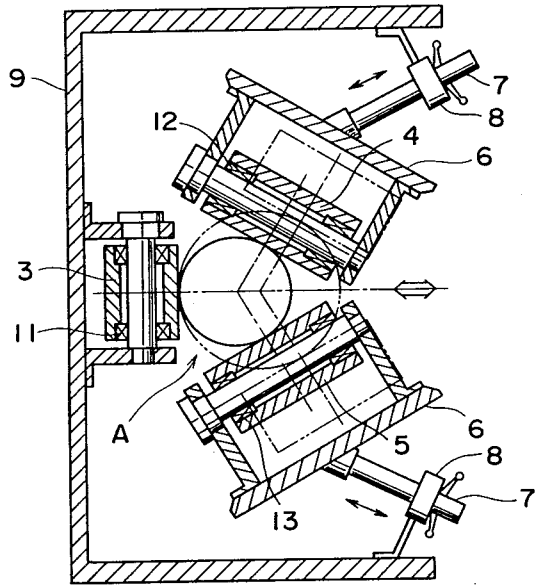

FIG. 2 is a schematic side view of a supporting and guiding apparatus for continuous rounds casting of the present invention, in which a mold M and a round bar A cast by the mold M and drawn therefrom are shown, FIG. 3 being a schematic cross sectional view thereof.

An apparatus of the present invention is in such a structure that stationary rolls 3, 3, . . . and movable frames 6, 6 are fixed to the stationary frame 9 positioned immediately below the mold M and movable rolls 4, 4, . . . and 5, 5, . . . are fixed to the abovesaid movable frames 6, 6.

The stationary frame 9 is formed in the shape of channel so that the lengthwise direction thereof (the direction shown by an arrow mark in FIG. 2 and along which the round bar A is drawn) is adapted to run from top to bottom and the open part thereof is directed to the center of radius R of curvature of the continuous casting machine (to the center of curvature of the round bar A). A part of the stationary frame 9 opposite to the open part thereof (a part opposite to the outside of curvature of the round bar A) is provided with a plurality of stationary rolls 3, 3, . . . disposed in the vertical direction.

On the other hand, movable rolls 4, 4, . . . and 5, 5, . . . are fixed to the movable frames 6 and 6 fixed to the stationary frame 9. On the rear side of the surface of each movable frame 6 opposite to the round bar A, guide rods 7 and 7 are erected, and a screw-threaded lever 10*a* of moving means 10 is erected in the mid-position between both guide rods 7 and 7. On either side of the stationary frame 9, two guide bushes 8 and 8 are mounted together with a handle 10*b* of moving means 10 to be disposed in the mid-position between these guide bushes 8 and 8. The handle 10*b* is provided with a screw-threaded hole and operates to move the guide bushes 8 through a handle holder or guide bush support 81. Both guide rods 7 and 7 are respectively inserted through both guide bushes 8 and 8, the threaded lever 10*a* being inserted through the threaded hole of the handle 10*b*. On the surface of each movable frame 6 opposite to the round bar A, a plurality of movable rolls 4, 4, . . . (or 5, 5, . . . ) are mounted along the vertical direction.

An angle for setting the guide rods 7 and 7 to the movable frame 6 and that for setting the guide bushes 8, 8 to the stationary frame 9 are determined, as shown in FIG. 3, so that the surface of the stationary frame 9 to which stationary rolls 3, 3, . . . are fixed and the surfaces of both movable frames 6 and 6 to which movable rolls 4, 4, . . . and 5, 5, . . . are fixed each lie on each side of a regular triangle. Rotating shafts of stationary rolls 3, 3, . . . are fixed to the stationary frame 9 in the direction parallel with the surface of the stationary frame 9 facing the round bar A and perpendicular to the drawing direction of the round bar A whereas rotating shafts of movable rolls 4, 4, . . . and 5, 5, . . . are fixed to movable frames 6, 6 in the directions parallel with the surfaces of movable frames 6 and 6 facing the round bar A and perpendicular to the drawing direction of the round bar A.

Thus, rolling-contact surfaces of a set of three rolls, that is, stationary one 3 and movable two 4 and 5, lying roughly on a plane perpendicular to the drawing direction of the round bar A, as shown in FIG. 3, constitute three sides of a regular triangle circumscribed around the outer periphery of the round bar A.

In the apparatus of the present invention constructed as above, both movable frames 6 and 6 are moved by turning the handle 10*b* of moving means 10 manually. Alternatively, a suitable power driven driving means may be utilized. At this time, both movable frames 6 and 6 and accordingly movable rolls 4, 4, . . . and 5, 5, . . . mounted thereon are moved in parallel translation, as shown in FIG. 3 indicating positions of movable rolls 4 and 5 by alternate long and two dashes lines, because an angular relation between the movable frame 6 and guide rods 7, 7 and that between the stationary frame 9 and guide bushes 8, 8 are fixed as described above. Therefore, an angular relation between three rolls 3, 4 and 5 is not varied even with the movement of movable rolls 4 and 5. In other words, rolling-contact surfaces of three rolls 3, 4 and 5 constitute three sides of a regular triangle which are always in contact with the outer periphery of the round bar A regardless of the size of round bar A.

In this way, the supporting and guiding apparatus of the present invention exactly supports, guides, and positions the round bar A even when the size (diameter) of the round bar A drawn from the mold M is changed.

Also, in this apparatus of the invention, considerably wide gaps are provided between rolls arranged along the drawing direction of the round bar A and thereby annular cooling sprays can easily be installed in these gaps so as to surround the round bar A.

Guiding of movable frames 6 and 6 depends on the guide rods 7, 7 and guide bushes 8, 8, however, other various types of guiding mechanism or link mechanism may be used. A hydraulic cylinder or the like may be used as moving means.

Bearing 11, 12 and 13 used for rolls 3, 4 and 5, respectively, may be of any type so far as permitting smooth revolution of rolls 3, 4 and 5.

In FIG. 3, three rolls 3, 4 and 5 are disposed in three positions spaced from each other at equal angular intervals, however, intervals are not necessarily equal.

When applying a dummy bar, a transition part of dummy bar connected at lower end of dummy bar head which is inserted into the mold is not necessary. A common part of dummy bar larger in outer diameter than the dummy bar head can be extended as long as reaching a position immediately below the mold after inserted through the apparatus of the present invention. That is to say, an operation may be performed in such a way that, at the start of use of a dummy bar, movable rolls 4 and 5 are kept withdrawn so as not to interrupt movement of the common part of dummy bar and, as casting starts and the head enters the supporting and guiding apparatus of the invention to pass therethrough, are moved to appropriate position relative to the dummy bar head. Thus, the common part of dummy bar can be greater in length than that used in the conventional supporting and guiding apparatus.

Figure 6:
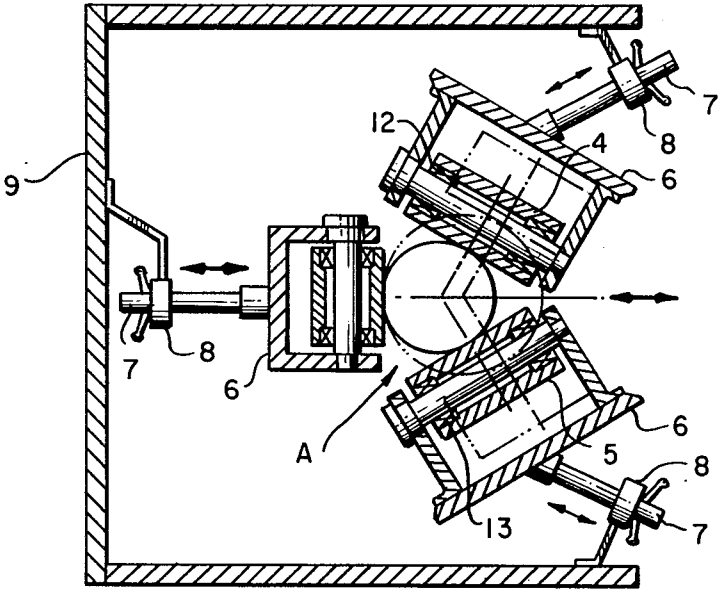
FIG. 6 is a schematic representation, similar to FIG. 3, of a further embodiment of the present invention.

Further, in this embodiment, a stationary roll 3 and movable rolls 4 and 5 fixed to a stationary frame 9 and movable frames 6 and 6 respectively, are disposed in four steps spaced from each other at pitches l along the drawing direction of the round bar A and movable rolls 4 and 5 are moved in company with the movement of the movable frames 6 and 6. However, for effectively satisfying the above purpose, it is possible to provide each of movable rolls 4, 4, . . . and 5, 5, . . . with moving means so that each roll may independently be moved (FIG. 6).

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof to be embraced by the claims.

What is claimed is:

1. A supporting and guiding apparatus for continuous rounds casting which supports and guides a round drawn from a mold of a continuous casting machine with a plurality of rolls disposed around said round, comprising:

a plurality of sets of rolls, each set being disposed along a drawing direction of said round and composed of three rolls which are disposed around a periphery of said round; and at least one roll of each set being fixed relative to said round and the remaining rolls being fixedly adjustable in a direction toward and away from a centerline of the drawing direction so as to accept various size rounds.

2. A supporting and guiding apparatus for continuous rounds casting as set forth in claim 1, wherein said rolls of each set are disposed with equal angular intervals in the circumferential direction of said round.

3. A supporting and guiding apparatus for continuous rounds casting as set forth in claim 1, wherein said continuous casting machine is of vertical type.

4. A supporting and guiding apparatus for continuous rounds casting as set forth in claim 1, wherein said continuous casting machine is of curvature type.

5. A supporting and guiding apparatus for continuous rounds casting as set forth in claim 4, wherein said roll whose position is fixed is disposed on outside of curvature of said continuous casting machine.

6. A supporting and guiding apparatus for continuous rounds casting which supports and guides a round drawn from a mold of a continuous casting machine with a plurality of rolls disposed around said round, comprising:

a plurality of sets of rolls, each set being disposed along a drawing direction of said round for supporting said round and having three rolls which are adapted to be disposed around a periphery of said round; and each roll of at least one of the sets of rolls being fixedly adjustable in a direction toward and away from a centerline of the drawing direction so as to accept various size rounds.

7. A supporting and guiding apparatus for continuous rounds casting as set forth in claim 6, wherein said rolls of each set are disposed with equal angular intervals in the circumferential direction of said round.

8. A supporting and guiding apparatus for continuous rounds casting as set forth in claim 6, wherein said continuous casting machine is of curvature type.

9. A supporting and guiding apparatus for continuous rounds casting as set forth in claim 6, wherein said continuous casting machine is of vertical type.

10. A supporting and guiding apparatus for continuous rounds casting as set forth in claim 6, wherein said continuous casting machine is of horizontal type.

11. A supporting and guiding apparatus for continuous rounds casting which supports and guides a round drawn from a mold of a continuous casting machine with a plurality of rolls disposed around said round, comprising:

a plurality of sets of three rolls, each set being disposed along a drawing direction of said round for supporting said round and said three rolls being adapted to be disposed around a periphery of said round;

said rolls of each set being positioned in rows at the same angular position relative to the rolls in the other sets with respect to a circumferential direction of said round; and the rows of rolls being fixedly adjustable in a direction toward and away from a centerline of the drawing direction so as to accept various size rounds.

12. A supporting and guiding apparatus for continuous rounds casting as set forth in claim 11, wherein said rows are disposed with equal angular intervals in the circumferential direction of said round.

13. A supporting and guiding apparatus for continuous rounds casting as set forth in claim 11, wherein said continuous casting machine is of curvature type.

14. A supporting and guiding apparatus for continuous rounds casting as set forth in claim 11, wherein said continuous casting machine is of vertical type.

15. A supporting and guiding apparatus for continuous rounds casting as set forth in claim 11, wherein said continuous casting machine is of horizontal type.

16. A supporting and guiding apparatus for continuous rounds casting which supports and guides a round drawn from a mold of a continuous casting machine with a plurality of rolls disposed around said round, comprising:

a plurality of sets of three rolls, each set being disposed along a drawing direction of said round and said three rolls being disposed around a periphery of said round;

said rolls of each set being positioned in rows at the same angular position relative to the rolls in the other sets with respect to a circumferential direction of said round; and one row of said rows being fixed relative to said round and the other two rows being fixedly adjustable in a direction toward and away from a centerline of the drawing direction so as to accept various size rounds.

17. A supporting and guiding apparatus for continuous rounds casting as set forth in claim 16, wherein said rows are disposed with equal angular intervals in the circumferential direction of said round.

18. A supporting and guiding apparatus for continuous rounds casting as set forth in claim 16, wherein said continuous casting machine is of vertical type.

19. A supporting and guiding apparatus for continuous rounds casting as set forth in claim 16, wherein said continuous casting machine is of curvature type.

20. A supporting and guiding apparatus for continuous rounds casting as set forth in claim 19, wherein said row whose position is fixed is disposed on outside of curvature of said continuous casting machine.

* * * * *

UNITED STATES PATENT AND TRADEMARK OFFICE

CERTIFICATE OF CORRECTION

PATENT NO. : 4,619,310

DATED : October 28, 1986

INVENTOR(S) : Tsuyoshi Andoh, Toshio Kanamori, Takashi Yamaguchi, Hiroshi Tomono and Satoshi Satake It is certified that error appears in the above-identified patent and that said Letters Patent is hereby corrected as shown below:

IN THE HEADING:

Correct the title as follows:

[54] SUPPORTING AND GUIDING APPARATUS FOR CONTINUOUS ROUNDS CASTING

IN THE SPECIFICATION:

At Column 1, above Line 5:

Correct the title as follows:

SUPPORTING AND GUIDING APPARATUS FOR CONTINUOUS ROUNDS CASTING

Signed and Sealed this

Twenty-seventh Day of January, 1987

*Attest:*

DONALD J. QUIGG

*Attesting Officer* *Commissioner of Patents and Trademarks*